US005872856A

United States Patent [19]

Huh

[11] Patent Number: 5,872,856

[45] Date of Patent: Feb. 16, 1999

[54] SURROUND SPEAKER

[75] Inventor: Man-Sun Huh, Kwacheon, Rep. of Korea

[73] Assignee: Samsung Electronics Co., Ltd., Kyungki-Do, Rep. of Korea

[21] Appl. No.: 813,428

[22] Filed: Mar. 10, 1997

[30] Foreign Application Priority Data

Mar. 11, 1996 [KR] Rep. of Korea ..... 1996/6355

[51] Int. Cl.[6] ..... H04R 25/00

[52] U.S. Cl. ..... 381/387; 381/304

[58] Field of Search ..... 381/205, 188, 381/87, 90, 24, 335, 332, 304, 305, 307, 310, 386, 387, 388

[56] References Cited

U.S. PATENT DOCUMENTS 4,757,544 7/1988 Guy ..... 381/90

*Primary Examiner*—Vivian Chang

*Attorney, Agent, or Firm*—Sughrue, Mion, Zinn, Macpeak & Seas, PLLC

[57] ABSTRACT

A surround speaker system implements the speaker of a dipolar acoustic radiation characteristic by being installed in an upper part of a speaker stand, or it implements a surround speaker of a monopolar acoustic radiation characteristic by being installed at a lower central part of the speaker stand. The speaker stand is capable of controlling the speaker's height.

11 Claims, 4 Drawing Sheets

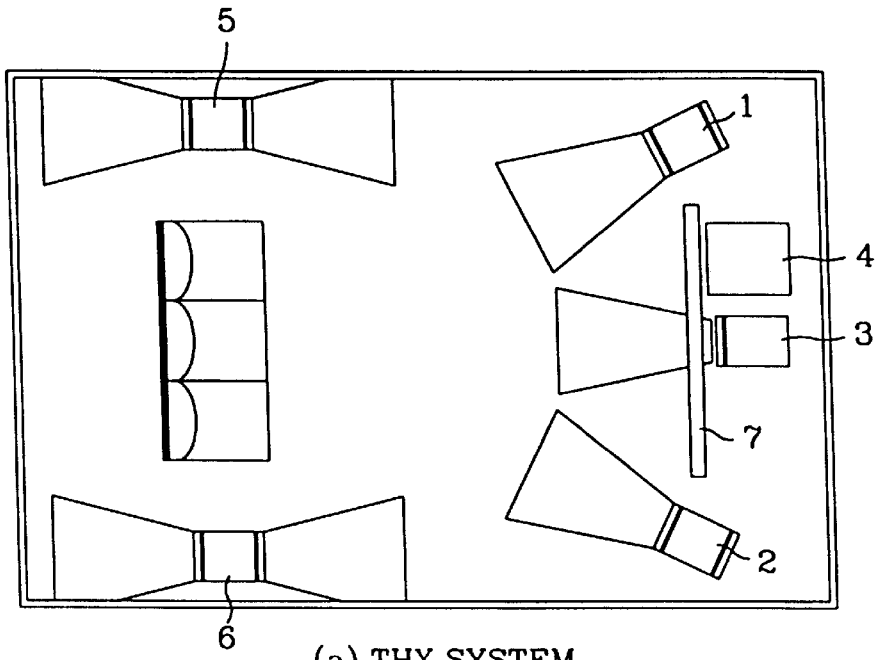
(a) THX SYSTEM
*Fig.* 1 PRIOR ART
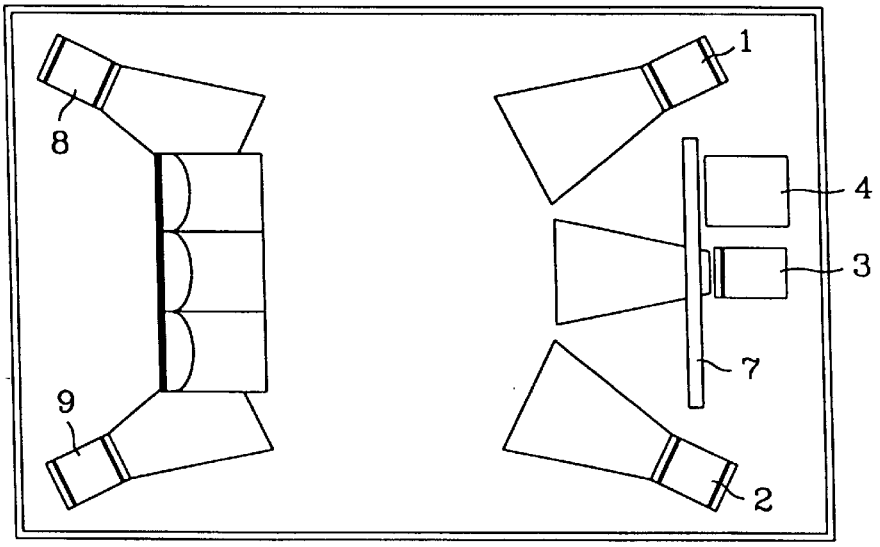
(a) AC−3 SYSTEM
*Fig.* 2 PRIOR ART

SURROUND SPEAKER

BACKGROUND OF THE INVENTION

1. Field of the Invention

This invention relates to a speaker system for a theatrical home sound system, THX and Dolby AC-3, and, more specifically, to a surround speaker satisfying two different kinds of sound systems; one is the THX which is a surround speaker having a dipolar acoustic radiation characteristic, and the other is Dolby AC-3 which is a surround speaker of a monopolar acoustic radiation characteristic.

2. Description of the Related Art

FIG. 1 illustrates the construction of a THX system having a feature of a dipolar acoustic radiation characteristic. FIG. 2 illustrates the construction of a Dolby AC-3 system of a monopolar acoustic radiation characteristic. Conventionally, as the surround speaker systems which are typical home theater sound systems, the THX and Dolby AC-3 systems commonly have three front speakers; that is, a left front speaker 1, a right front speaker 2, a center speaker 3, and a sub-woofer 4. However, they have different surround speaker forms as follows.

While the THX system basically has the surround speakers 5 and 6 having a left and right dipolar acoustic radiation characteristic, the Dolby AC-3 system has the general left and right surround speakers 8 and 9 thereby providing a monopolar acoustic radiation characteristic. The THX surround speaker is preferably set up at a height of 1.5 to 3 m, but the Dolby AC-3 surround speaker is preferably set up at a height of 60 to 80 cm like a general speaker. In FIGS. 1 and 2, the reference numeral 7 indicates a screen.

Since the surround speaker 5,6 of the THX system is placed at the side of an audience and radiates sound bilaterally, the audience hears indirect sound rather than direct sound. Alternately, the surround speaker 8,9 of the Dolby AC-3 system allows the audience to possibly hear the direct sound.

However, the conventional surround speakers of a THX surround system and Dolby AC-3 system have a problem in their interchangeability. While the front speakers have nothing to do with this problem, the surround speakers involve such a problem because they are different from each other. For example, the surround effect becomes unnatural in the case where a sound medium in which recording is performed by the Dolby AC-3 method is reproduced through the speaker of a THX sound system. To solve the above problem, both THX and Dolby AC-3 surround speakers should be used, or alternatively only the medium for one method should be used.

SUMMARY OF THE INVENTION

An object of the present invention is to provide a surround speaker which can serve both as a THX surround speaker and a Dolby AC-3 surround speaker through a simple operation.

To achieve the objects of the present invention, there is provided a surround speaker system implementing a dipolar acoustic radiation characteristic speaker by being installed in an upper part of a speaker stand, or implementing a surround speaker of a monopolar acoustic radiation characteristic by being installed at a lower central part of the speaker stand. The speaker stand is capable of controlling the speaker's height.

BRIEF DESCRIPTION OF THE DRAWINGS

The above objects and advantages of the present invention will become more apparent from the following detailed description when read in connection with the accompanying drawings, in which:

FIG. 1 illustrates the construction of a THX system having a surround speaker of a dipolar acoustic radiation characteristic;

FIG. 2 illustrates the construction of a Dolby AC-3 system having a surround speaker of a monopolar acoustic radiation characteristic;

DETAILED DESCRIPTION OF THE PREFERRED EMBODIMENT

Figure 3A:
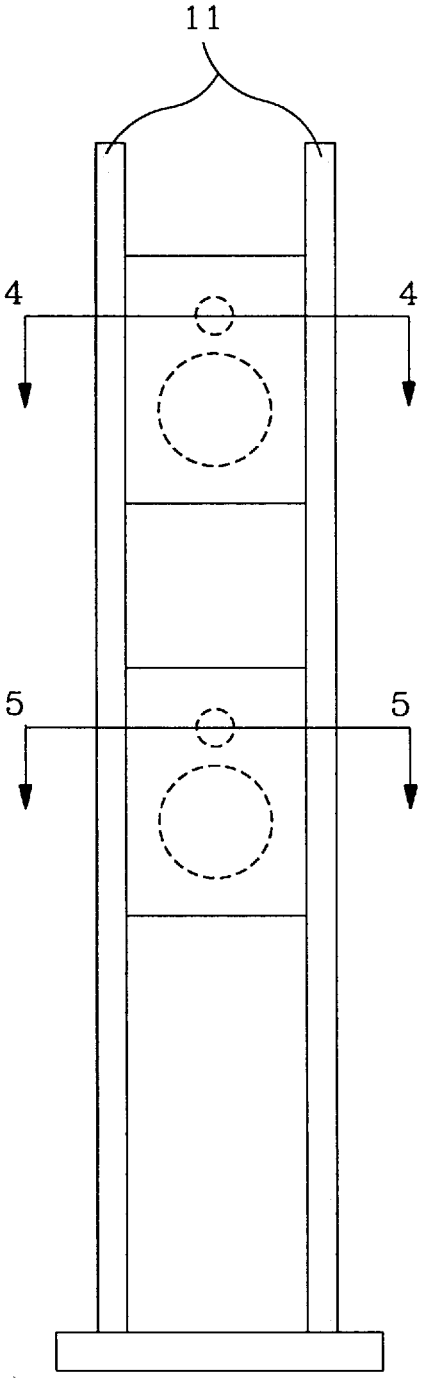
FIGS. 3A and 3B are front and side views of a surround speaker set up according to the present invention, respectively.
Figure 3B:
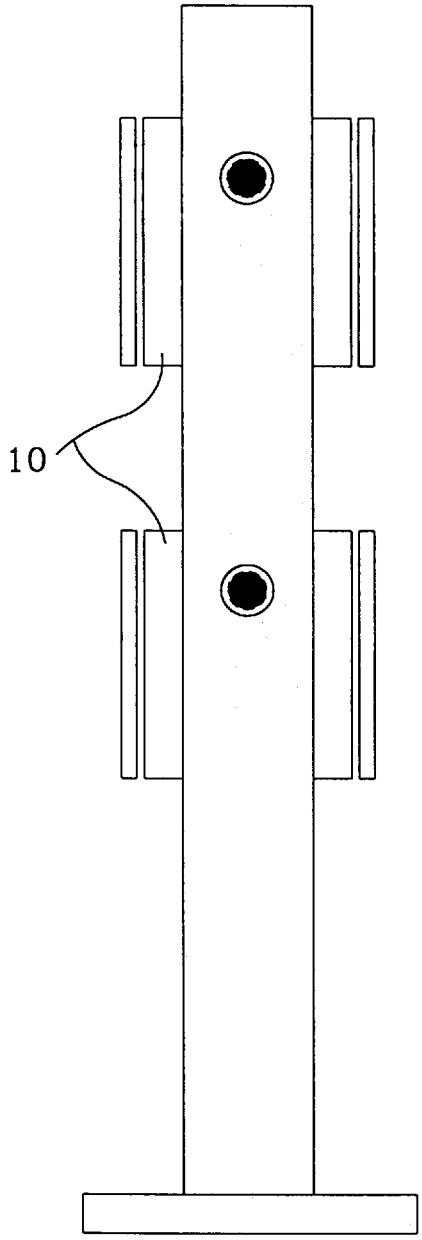

With reference to the attached drawings, a preferred embodiment of the present invention will now be described below in detail.

Referring to FIGS. 3 to 6, the construction and effect of the present invention are set forth in the description which follows. Please keep in mind that components having the identical functions with those of the conventional system are given the same reference numbers everywhere if possible.

There is a surround speaker which has the dipolar acoustic radiation characteristic according to a height of a dipolar speaker set up, or which is operated in a monopolar acoustic radiation characteristic. A speaker stand 11 is composed of two stand posts 18 standing face to face on opposite sides of a bottom board B. A signal input plate 19, installed in each of the stand posts 18, transmits a signal to the front and rear speaker drivers 14 and 13 selectively according to the height of a speaker box 12 of a surround speaker's body 10. A non-conductive plate 21 is installed in the lower part of each of the stand posts 18 (see FIG. 6). In order to operate the speaker as the THX surround speaker having the dipolar acoustic radiation characteristic, the speaker's input port 15 is connected to the signal input plate 19 of the speaker stand 11 through joining the speaker to the upper part of the stand post 18 with a coupling bolt 20. To achieve the operation of the Dolby AC-3 surround speaker of the monopolar acoustic radiation characteristic, only the front speaker driver 14 is connected to the signal input plate 19 through joining the speaker to the lower part of each of the stand posts 18 with the coupling bolt 20.

The front and rear drivers 14 and 13, and a crossover network 16 are disposed in the speaker box 12 of the surround speaker's body 10. The input port 15 is installed at both sides of the speaker. They are all connected to one another through an internal wiring 17.

The upper part of the signal input plate 19 of the speaker stand 11 is divided into two sides, and the end of its lower part is connected to an amplifier output cable 22.

As described above, in the case where the speaker's body 10 is installed in the upper part of the stand posts 18 of the speaker stand 11, the speaker is operated as the THX surround speaker which has the dipolar acoustic radiation characteristic. In the case where the speaker's body 10 is installed generally below the center of the stand posts 18, the speaker is operated as the Dolby AC-3 surround speaker of the monopolar acoustic radiation characteristic.

For the purpose of operating the speaker as the THX surround speaker, the speaker's body 10 should preferably be placed at a height of 150 cm away from the bottom. In order to operate the speaker as the Dolby AC-3 surround speaker, it should preferably be placed at a height of 60 to 80 cm away from the bottom.

Figure 4:
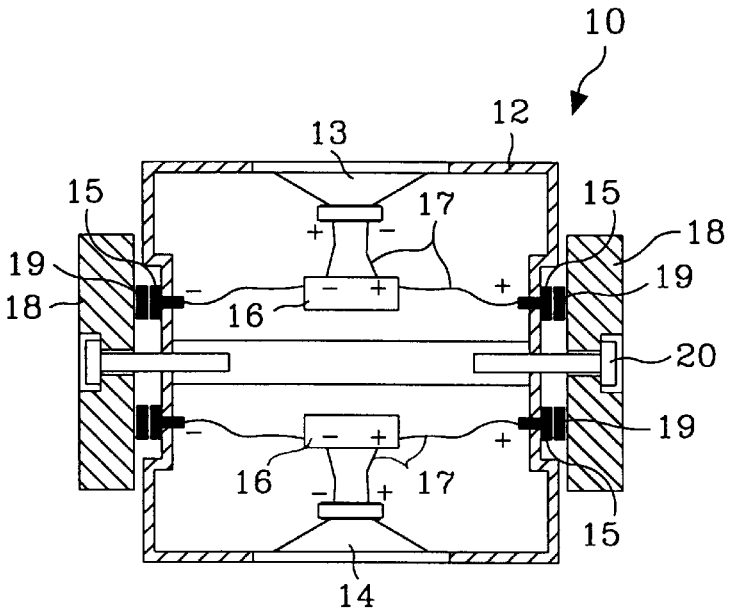
FIG. 4 is a sectional view taken along line 4—4 of FIG. 3A.
Figure 5:
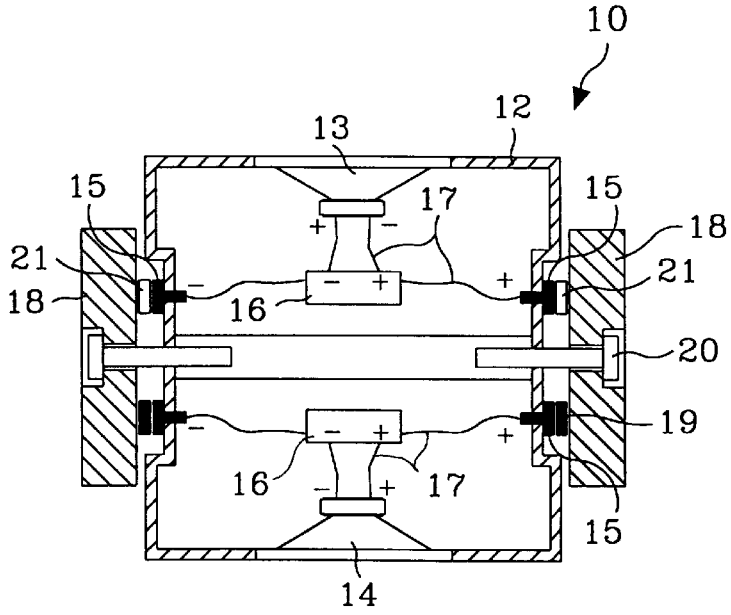
FIG. 5 is a sectional view taken along line 5—5 of FIG. 3A.
Figure 6:
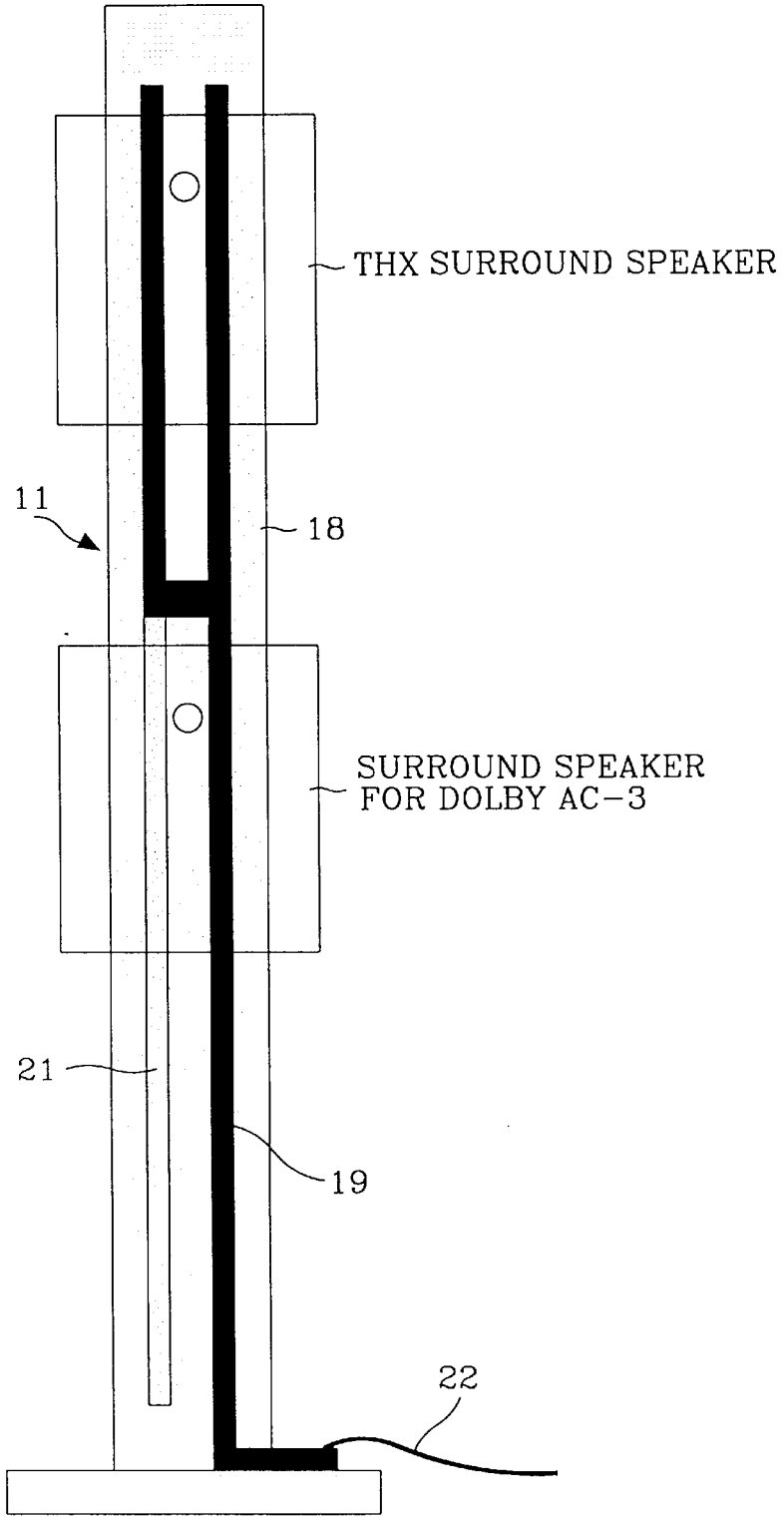
FIG. 6 illustrates the construction of a speaker stand according to the present invention.

When the speaker's body 10 is installed in the upper part of the stand posts 18, as shown in FIG. 4, the signal input from the signal input plate 19 of the speaker stand 11 passes through the speaker input ports 15 and the crossover networks 16 which are installed in the speaker box 12. Then the signal is transmitted to the front and rear drivers 14 and 13 through the internal wiring 17. Therefore, the speaker is operated as the THX surround speaker which bilaterally radiates sound. Alternately, when the speaker's body 10 is installed at the lower central part of the stand posts 18 of the speaker stand 11, as shown in FIG. 5, the signal from the signal input plate 19 of the speaker stand 11 passes through the speaker input port 15 and the crossover network 16. Then the signal is transmitted to only the front driver 14. Therefore, the speaker is operated as the Dolby AC-3 surround speaker which unilaterally radiates sound.

According to the present invention described above, there is provided the surround speaker which is operative to serve both as the THX and Dolby AC-3 surround speaker systems through simple manipulation, thereby providing a user with convenience. Besides, two pairs of surround speakers are not necessary in producing both the THX and Dolby AC-3 surround speakers in this invention, thereby reducing the cost and space for installing the speakers.

It is contemplated that numerous modifications may be made to the surround speaker of the present invention without departing from the spirit and scope of the invention as defined in the following claims.

What is claimed is:

1. A surround speaker system having a speaker stand and a speaker which is operative to serve as one of a surround speaker of a dipolar acoustic radiation characteristic and a surround speaker of a monopolar acoustic radiation characteristic, the dipolar acoustic radiation characteristic being implemented by installing the speaker at an upper part of the speaker stand, and the monopolar acoustic radiation characteristic being implemented by installing the speaker to a lower central part of the speaker stand, the speaker stand being operative to control a mounting height of the speaker.

2. The system according to claim 1, wherein the speaker stand has a bottom board and rectangular stand posts standing face to face on opposite sides, of the bottom board.

3. The system according to claim 2, further comprising a signal input plate attached to an inner surface of each of the speaker stand posts, for selectively transmitting a signal to at least one of front and rear speaker drivers according to the mounting height of the speaker.

4. The system according to claim 3, further comprising an amplifier output cable connected to a lower end of the signal input plate.

5. The system according to claim 2, further comprising a non-conductive plate attached to an inner lower surface of each of the speaker stand posts.

6. The system according to claim 3, wherein the surround speaker of the dipolar acoustic radiation characteristic is implemented by joining the speaker to the upper part of the stand with a coupling bolt so as to connect an input port of the speaker to the signal input plate.

7. The system according to claim 3, wherein the surround speaker of the monopolar acoustic radiation characteristic is implemented by joining the speaker to the lower part of the stand with a coupling bolt so as to connect one of the front speaker driver and the rear speaker driver to the signal input plate.

8. The speaker according to claim 1, wherein the speaker comprises a front speaker driver, a rear speaker driver, first and second speaker inputs on opposite sides thereof, a first crossover network, and internal wiring which connects the first and second speaker inputs to the first crossover network and also connects the first crossover network to the front speaker driver; and third and fourth speaker inputs on opposite sides of the speaker, a second crossover network, and further internal wiring which connects the third and fourth speaker inputs to the second crossover network and also connects the second crossover network to the rear speaker driver.

9. A surround speaker system comprising:

a speaker operative either as a surround speaker of a dipolar acoustic radiation characteristic or a surround speaker of a monopolar acoustic radiation characteristic, the speaker having a front speaker driver and a rear speaker driver;

a speaker stand having a bottom board and stand posts standing face to face on opposite sides of the bottom board, each of the stand posts having a signal input plate for selectively transmitting a signal to the front and rear speaker drivers according to a mounting height of the speaker on the speaker stand, each of the stand posts also having a non-conductive plate installed at a lower part;

wherein the surround speaker of the dipolar acoustic radiation characteristic is implemented by mounting the speaker at an upper part of the stand posts so as to join a speaker input port to the signal input plate; and wherein the surround speaker of the monopolar acoustic radiation characteristic is implemented by mounting the speaker at a lower central part of the stand posts so as to join only the front speaker driver to the signal input plate.

10. The system according to claim 9, wherein the speaker further comprises:

first and second speaker inputs on opposite sides thereof, a first crossover network, and internal wiring which connects the first and second speaker inputs to the first crossover network and also connects the first crossover network to the front speaker driver; and third and fourth speaker inputs on opposite sides of the speaker, a second crossover network, and further internal wiring which connects the third and fourth speaker inputs to the second crossover network and also connects the second crossover network to the rear speaker driver.

11. The system according to claim 9, further comprising an amplifier output cable connected to a lower end of the signal input plate.

* * * * *